US007036706B2

(12) United States Patent
Mochizuki et al.

(10) Patent No.: US 7,036,706 B2
(45) Date of Patent: May 2, 2006

(54) STAPLER APPARATUS

(75) Inventors: Naoto Mochizuki, Yamanashi-ken (JP); Yousuke Saijiki, Yamanashi-ken (JP)

(73) Assignees: ACCO Brands USA LLC, Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/450,061

(22) PCT Filed: Dec. 21, 2001

(86) PCT No.: PCT/IB01/02621

§ 371 (c)(1),
(2), (4) Date: Oct. 30, 2003

(87) PCT Pub. No.: WO02/053326

PCT Pub. Date: Jul. 11, 2002

(65) Prior Publication Data

US 2004/0069830 A1 Apr. 15, 2004

(30) Foreign Application Priority Data

Dec. 28, 2000 (JP) ..... 2000-402781

(51) Int. Cl.
*B25C 5/15* (2006.01)

(52) U.S. Cl. ..... 227/131; 227/134; 227/136; 227/155; 227/120

(58) Field of Classification Search ..... 227/85, 227/121, 126, 131, 134, 155, 120, 136, 138
See application file for complete search history.

(56) References Cited

U.S. PATENT DOCUMENTS

| | | | | |
|---|---|---|---|---|
| 3,009,618 | A | 11/1961 | Lerner | |
| 3,279,673 | A | 10/1966 | Schafroth et al. | |
| 3,602,414 | A | 8/1971 | Garfinkel | |
| 4,542,844 | A * | 9/1985 | Olesen et al. | 227/7 |
| 4,588,121 | A * | 5/1986 | Olesen | 227/120 |
| 4,770,334 | A * | 9/1988 | Hoshi et al. | 227/85 |
| 4,978,045 | A * | 12/1990 | Murakami et al. | 227/1 |
| 5,230,457 | A * | 7/1993 | Hiroi et al. | 227/2 |
| 6,371,352 | B1 * | 4/2002 | Mochizuki | 227/155 |

* cited by examiner

*Primary Examiner*—Rinaldi I. Rada
*Assistant Examiner*—Nathaniel Chukwurah
(74) *Attorney, Agent, or Firm*—Michael Best & Friedrich LLP

(57) ABSTRACT

The present invention is to provide a staple cartridge that can offset any discrepancies when mounting a staple cartridge, even if staples are slightly offset to check the occurrence of stapling defects. The staple cartridge 100 of the holding means 200 which is equivalent to the cartridge holder disposed as either a body separate to the stapler unit 300 or unitized thereto, actuates the staple feeds means 202. Even if the position of the staple pulled out from the staple cartridge is offset, this action corrects the offset to correctly set the staple at the driving position thereby enabling it to check stapling defects that occur because of mis-positioning of the staple set position.

14 Claims, 5 Drawing Sheets

STAPLER APPARATUS

BACKGROUND OF THE INVENTION

The present invention relates to a stapler apparatus which binds a plurality of documents printed with a copying machine, a printer, or a composite of machines thereof, etc., with staples.

Such stapler apparatuses conventionally are mounted with a staple cartridge therein storing rolled sheets of rolled bands of staples that are linked to form a sheet, or stacks of sheets of staples. The staple sheets in the staple cartridge are pulled out, and are drawn sequentially to a staple driving position and then driven into media for binding.

It is a precondition that the staple sheet in the aforementioned staple cartridge be pulled to a determined position at the leading edge of the cartridge when mounting to a cartridge holder that is either a body separate to the stapler apparatus or unitized thereto, to mount the staple cartridge to the stapler apparatus.

However, if the staple is not completely pulled out, for example, by carelessly forgetting to check beforehand, and the staple is offset one staple width, say 0.4 to 0.5 mm, it will not be at the proper driving position, thus nothing will be driven. If the amount of offset of a staple is, for example, 0.2 mm to 0.3 mm, the staple will not be completely set at the driving position, thus resulting in the driver striking only the edge of the staple. The staple, then, will become bent partway making it impossible to be driven, and easily causing defective bindings. Thus, there is the problem of not being able to staple securely from the first staple after mounting the staple cartridge.

An object of the present invention, in view of the aforementioned problem, is to provide a staple cartridge that can offset any discrepancies when mounting a staple cartridge, even if staples are slightly offset to check the occurrence of stapling defects.

SUMMARY OF THE INVENTION

The invention provides a stapler apparatus comprising a staple cartridge for storing sheets of staples linked into sheets, a holding means for mounting the staple cartridge and a staple feeding means for pulling out the staple sheet in the aforementioned staple cartridge and sequentially feeding staples to a staple driving position, equipped with an actuating means for actuating the aforementioned staple feeding means through the mounting action to the staple cartridge holding means to feed the aforementioned staples, when mounting the aforementioned staple cartridge to the aforementioned holding means.

According to this invention, the mounting action of the staple cartridge to the holding means, which corresponds to the cartridge holder that is either a body separate to the stapler apparatus or unitized thereto, actuates the staple feed means. Even if the position of the staple pulled out from the staple cartridge is offset, this action corrects the offset to correctly set the staple at the driving position thereby enabling it to check stapling defects that occur because of mis-positioning of the staple set position.

In one aspect of the invention, the actuating means is configured so that the sheet feeding means comprises a feed pawl and rocks around a rocking pivot point and comprises an abutting protrusion to abut and to rock the rocking arm disposed on the feeding means and the aforementioned rocking arm disposed on the staple cartridge.

According to the instant invention, a rocking arm is disposed on the staple feeding means that corresponds to a conventional feed pawl. An abutting protrusion is disposed to a staple cartridge to abut and rock a rocking arm without causing any new problems with regard to the specifications.

In another aspect of the invention, the actuating means comprises the relationship wherein x is the gap between the driving position and the leading edge of the staple, y is the amount of displacement of the rocking arm by the abutting protrusion, R2 is the length of the rocking arm from the rocking pivot and R1 is the length of the feed pawl from the rocking pivot, the relationships being expressed in the following manner.

$$R1\ \sin(y/2\pi R2*360°)>x$$

According to this invention, by disposing the rocking arm of the staple feeding means and the abutting protrusion on the staple cartridge so that they are in positions equivalent to that prescribed in the equation above, it is possible to securely draw staples to the driving means using the staple feeding means.

Below, an embodiment of the stapler apparatus according to the present invention will be described in accordance with the figures provided.

| | |
|---|---|
| 100 | Staple cartridge |
| 101 | Staple sheet material |
| 106 | Leading edge stopper |
| 107 | Feed pawl advancing protrusion (Abutting protrusion) <Actuating Means> |
| 200 | Cartridge holder <Holding means> |
| 202 | Staple feed means |
| 202a | Feed pawl member |
| 202a2 | Feed pawl |
| 202a4 | Cartridge advancing arm (Rocking Arm) <Actuating Means> |
| 202b | Feed pawl spring |
| 300 | Stapler unit |
| 700 | Urging means (Interposing plate) |

DETAILED DESCRIPTION OF THE INVENTION

Figure 1:
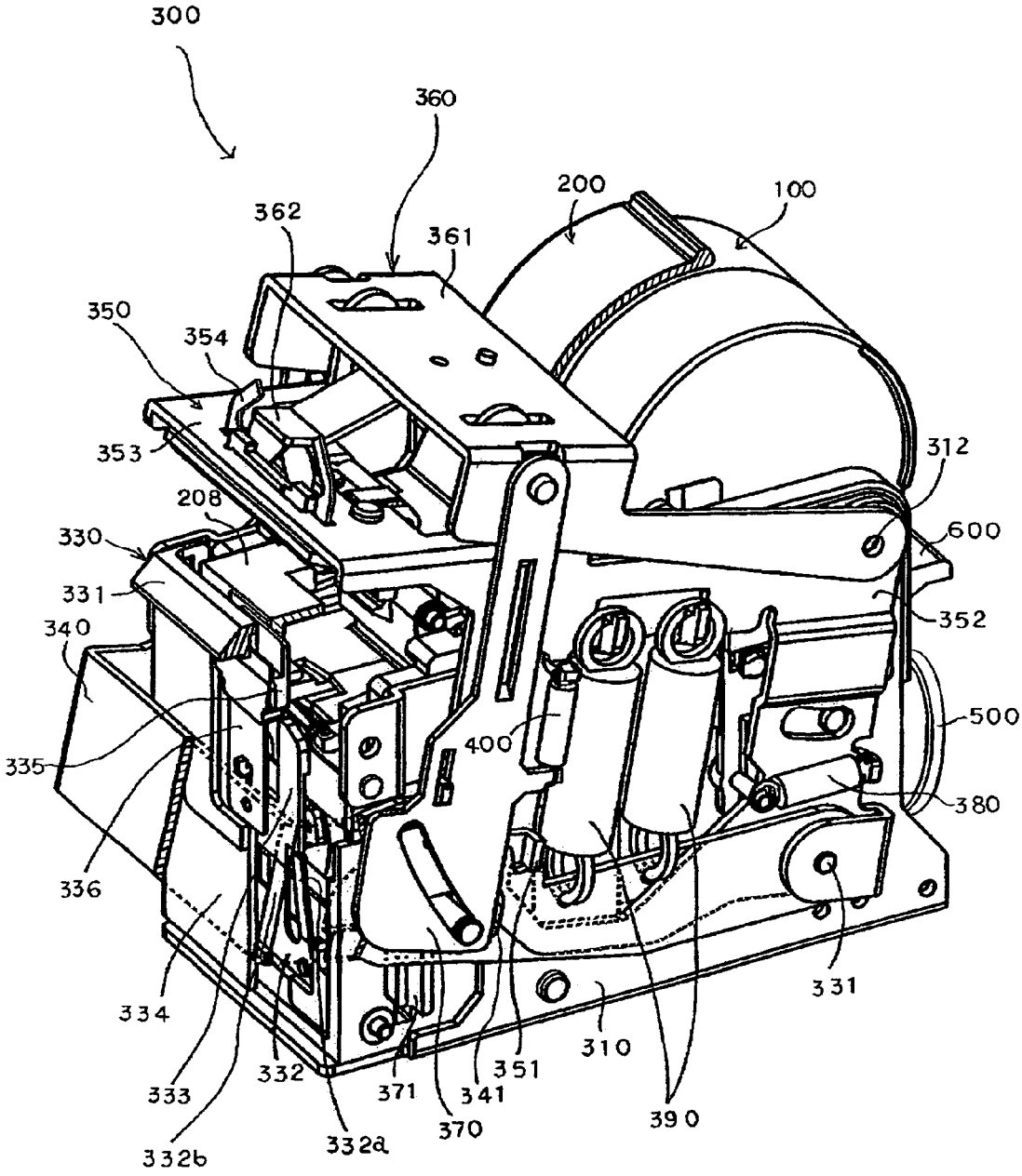
FIG. 1 A plan view comprising a sectional view of a stapler device mounted with the staple cartridge according to the embodiment of the instant invention.

FIG. 1 is an external perspective view showing a section of part of the entire stapler apparatus, mainly comprising the staple cartridge 100, the cartridge holder 200 and the stapler unit 300.

Firstly, to describe the apparatus according to the sequence of its assembly, the stapler unit 300 comprises the unit frame 310, the electric drive unit, not shown in the figures, the staple head unit 330, the actuating lever 340, the anvil unit 350, the clincher unit 360, the interlock lever 370, the anvil spring 380, the paper thickness absorbing springs 390, the clincher spring 400 and the manual drive plate 500.

Figure 2:
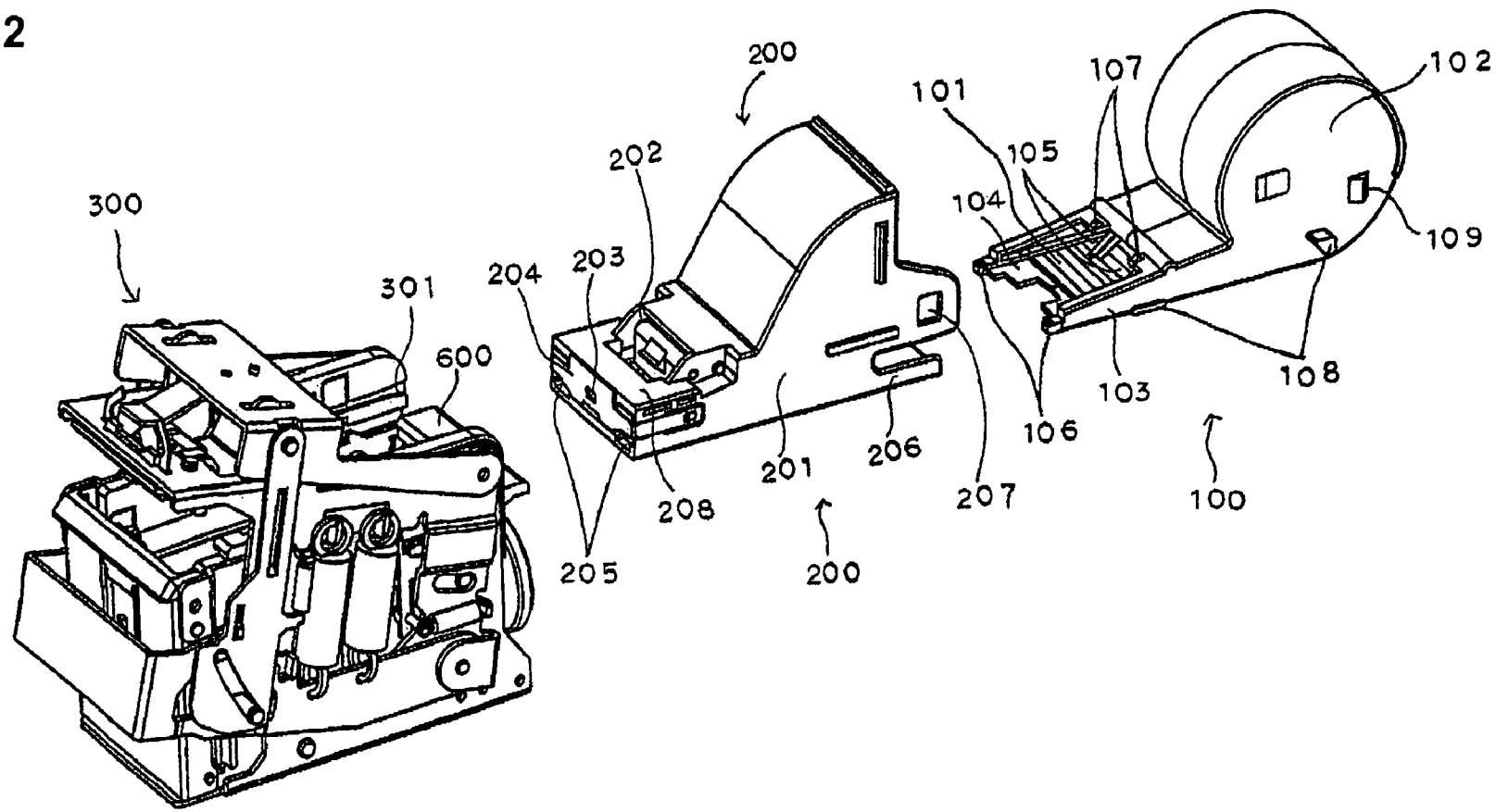
FIG. 2 A plan view of the disassembled units of the stapler device mounted with the staple cartridge according to the embodiment of the instant invention.

The unit frame 310 is sheet metal pressed formed into a sectional U-shape comprising sides established left and right and bottom. Internally, it holds the electric drive unit, thereabove the holding guide 301, which is shown in FIG. 2 and the staple head unit 330 in the leading edge and properly supports other units outside of the sides.

Note that the electric drive unit, which is not shown in the figures, is composed of a direct-current motor that is the stapler drive source, the gear train that decelerates the rotation of the motor to a determined rotating speed and the transmission cams that are decelerated to the determined speed to rotate. Each transmission cam drives the staple head unit 330 and by driving the anvil unit 350 and the clincher unit 360 via the actuating lever 340 and the interlock lever interlock lever 370, it controls the series of operations of the stapler.

The staple head unit 330 comprises the sheet loading table 331, the driver 332, the former 333, the sheath 334 and the bending block 335.

The staple head unit 330 starts the upward direction displacement of the driver 332 pressed formed with a leaf spring material, with the driver drive cam pin which is disposed on the final stage of the electric drive unit.

Displacement of the driver 332 abuts the former abutting piece 332*a* on the driver 332 against the former 333. The driver 332 and former 333 follow a stepped surface, not shown in the figures, formed on the sheath 334 upward to a position where that abutment is released.

The former 333 bends into a U-shape the staples drawn to the staple bending position of the bending block 335 and holds U-shaped staples on the sides of the former 333 thereof to drivably guide them. Note that the position where the staple is bent by the former 333 corresponds to the staple driving position below.

In this state, the driver 332 released from abutting the former 333 by the protrusion, not shown in the drawings, formed on the sheath 334, is displaced further upward leaving the former 333 in that position.

By displacing upward, the staple driving unit 332*b* positioned at the leading edge of the driver 332 displaces the bending block 335 to the front from the range of movement of the driver 332 and retracts.

The staple driving unit 332*b* on the driver 332 displaced further upward separates from the adhesive staples that have been bent and that are adhering to a subsequent staple by adhesive tape. Formed and separated staples are driven into the binding means.

Next, the actuating lever 340 has an arm extending left and right along the side surfaces of the anvil unit 350. While nipped in the unit frame 310, it is supported by the interlocking pivot shaft 331 disposed on the anvil unit 350.

In addition, the paper thickness absorbing springs 390 are stretched between the anvil unit 350 and in a central location on the left and right arms of the actuating lever 340. These springs 390 constantly urge in the counterclockwise direction around the interlocking pivot shaft 331 to touch the stopper 351 formed on the anvil unit 350.

The notch 341 comprising an edge to abut with the anvil drive lever, which is not shown in the figures, driven to displacement by the electric drive unit, is formed on the leading edge of the arm positioned on the other edge of the left and right arms. The anvil drive lever swings clockwise around the interlocking pivot shaft interlocking pivot shaft 331, which is pressed and urged downward.

The anvil unit 350, the anvil rocking pivot 352 on one side thereof rockingly supported on the pivot shaft 312 on the unit frame 310, is constantly rotatingly urged in the clockwise direction by the anvil spring 380 around the pivot shaft 312.

The anvil head 353 on the other side follows the rocking of the actuating lever 340 and rocks counter-clockwise resisting the urging force of the anvil spring 380 to nip and support the binding means at a position that corresponds to the thickness thereof.

Note that after the anvil unit 350 nips and supports the binding means by the paper thickness absorbing springs 390, the actuating lever 340 continues acting alone resisting the resilient force of the paper thickness absorbing springs 390.

To the anvil head 353 that nips the binding means of the anvil unit 350, the clincher unit 360 that has the left and right paired clinchers 354 for bending the leading edges of staples that have penetrated the binding means driven from below the binding means, is disposed follow.

The clincher unit 360 comprises the clincher lever 361 and is supported by the pivot shaft 312 on the unit frame 310 which is also the pivot for the anvil rocking pivot 352 on the anvil unit 350. To the leading edge of the clincher unit 360 is mounted the clincher head 362 that rocks the clincher 354 mounted to the anvil head 353 on the anvil unit anvil unit 350 and bends staples that have been driven.

The clincher head 362 absorbs the difference in pressing stroke of the clincher 354 because it is press formed using a steel plate for a spring with a thickness of 1.5 mm while the clincher lever 361 is formed using a plated steel plate of a thickness of 2.0 mm.

The interlock lever 370 is slave to the rocking of the anvil unit 350 via the clincher spring 400 and rocks the clincher unit 360. The anvil unit 350 is disposed to continue rotating with the rocking of the clincher drive lever, which is not shown in the figures, while the binding means is nipped and stopped. After the anvil unit 350 stops at the nipping position that corresponds to the thickness of the binding means, it continues rotating to bend the staples.

The manual drive plate 500 resets stapling defects by manually operating the stapler when a staple is not properly driven by the binding means. A defective staple prevents the stapler apparatus from operating and thus causes a stapling problem, when driving staples. The manual drive plate is mated to the rotation shaft extending to the back side of the output shaft of the direct current motor of the electric drive unit, which is not shown, when manual operations are necessary.

FIG. 2 is an exploded perspective view showing the cartridge holder 200 and staple cartridge 100 that are mounted on the stapler unit 300 in FIG. 1, pulled out.

When pulling from the stapler unit 300, first the cartridge lock lever 600 which abuts the staple cartridge 100 and urgingly supports in the mounting direction is pressed downward to release the abutting, then the staple cartridge 100 is pulled from the cartridge holder 200.

Then, the cartridge holder 200 is removed from the stapler unit 300. Conversely, it is also possible to remove the staple cartridge 100 from the cartridge holder 200 after pulling out the cartridge holder 200 while the staple cartridge 100 is mounted to the cartridge holder 200.

Note that the reverse procedures are acceptable when mounting the staple cartridge 100 and cartridge holder 200 to the stapler unit 300.

The staple cartridge 100 is composed of a semi-transparent plastic case and comprises the storage unit 102 that stores the staple sheet material 101 into which sheets of a plurality of straight staples linked into a band are wrapped into a roll, and the pull-out guide 103 for pulling out the staple sheet material 101.

The pull-out guide 103 is mounted to the cartridge holder 200 and is equipped with the opening 104 the guide surface on the leading top side being widely cut away to abut the staple feed means 202 on the cartridge holder 200, the back-feed stopper pawl 105 to arrest so that the staple sheet material 101 pulled out from the storage unit 102 does not return back into the storage unit 102, and the leading edge stoppers 106 that restricts the leading edge of the staple sheet material 101 that has been pulled out and that positions the leading edge thereof at the binding position while mounted to the stapler unit 300.

Also, it comprises the feed pawl advancing protrusion 107 that protrudes into the guide surface on the top-side of the leading edge formed on the opening 104 on the pull-out guide 103 and advances the staple feed means 202 when mounting to the cartridge holder 200 to press the leading edge of staples in the staple sheet material 101 to the leading edge stoppers 106.

Furthermore, to both sides of the staple cartridge 100 are equipped the guide protrusion 108 guided when mounting to the cartridge holder 200 and the stopper pawl 109 stopped when mounting to the cartridge holder cartridge holder 200.

Though not shown in the figures, it is possible to open the bottom portion by bending the staple cartridge 100 from an appropriate position on the back-feed stopper pawl 105 and the leading edge stoppers 106 to the storage unit 102. By opening, the back-feed stopper pawl 105 is released from stopping the staple sheet material 101 thereby making it possible to discard all remaining staples when discarding.

The cartridge holder 200 is composed of the holder unit 201, the staple feed means 202, the magnet 203, the guide plate 204 comprising a non-magnetic body, the opening 205, the guide 206, the abutting hole 207 and the supplementary table 208.

The holder unit 201 is formed of a plastic material to cover the front half of the staple cartridge 100.

The staple feed means 202 is rockingly supported on the holder unit 201 and is constantly urged to the table pull-out direction by a leaf spring, which is not shown in the figures. It is interlocked to the nipping action of the binding means by the anvil unit 350 and is charged. It comprises a feed pawl for pressing the staple sheet surface of the staple sheet material 101 with the recovery action caused by the release of the charge to advance the staple sheet material 101.

The magnet 203 and the guide plate 204 faces the staple to be driven at the binding position when mounted to the stapler unit 300 and the magnetic attraction of the magnet pulls mis-driven staples to discharge them outside from the stapler unit 300.

The opening 205 is the opening for setting the leading edge of the stoppers 106 on the staple cartridge 100 and the leading edge staple to protrude and set at the binding position The guide 206 is for guiding the guide protrusion 108 on the staple cartridge 100 and is composed of a cut-out groove and a bottom surface.

The abutting hole 207 abuts the stopper pawl 108 on the staple cartridge 100 and it is one of the supplementary stopping means on the staple cartridge 100 until the staple cartridge 100 is locked by the cartridge lock lever 600.

The supplementary table 208 acts as the loading table where the binding means is loaded along with the table 331 on the staple head unit 330, as shown in FIG. 1, when mounted to the stapler unit 300.

Figure 3:
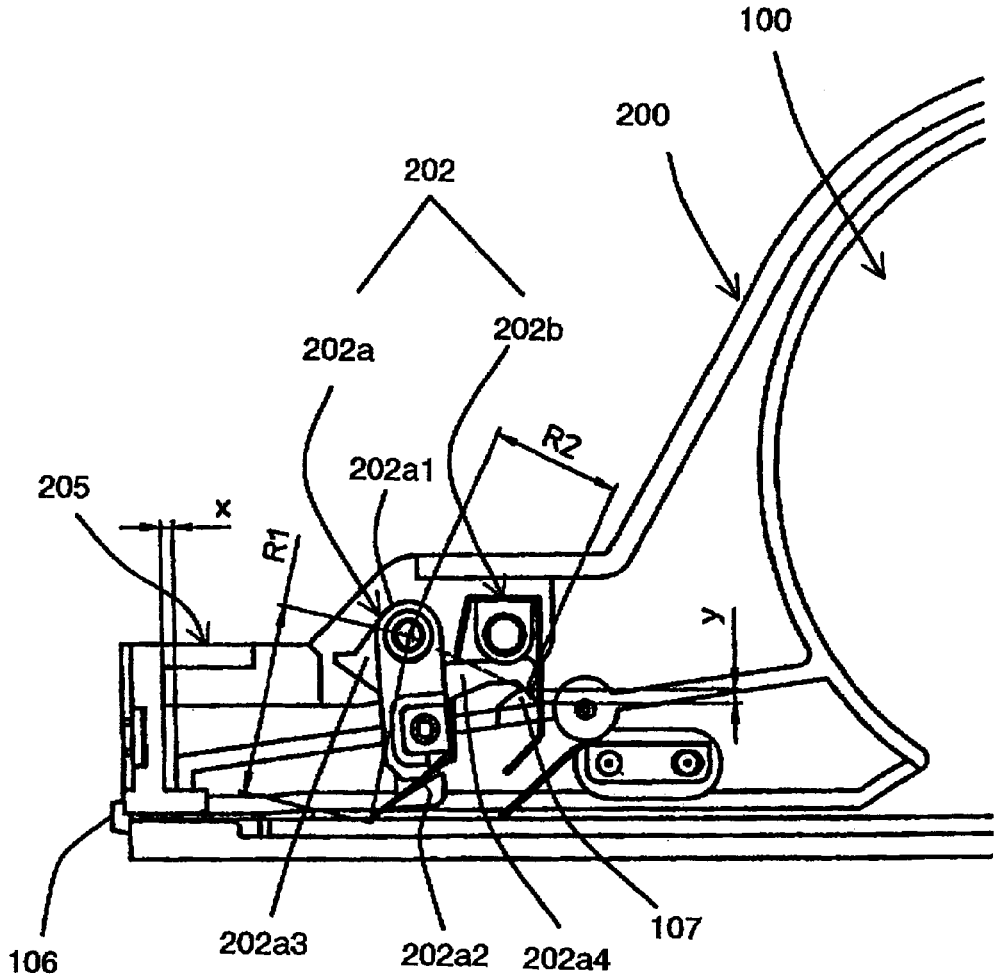
FIG. 3 A expanded operational view to illustrate the series of operations to mount the staple cartridge to the cartridge holder according to the embodiment of the instant invention.
Figure 4:
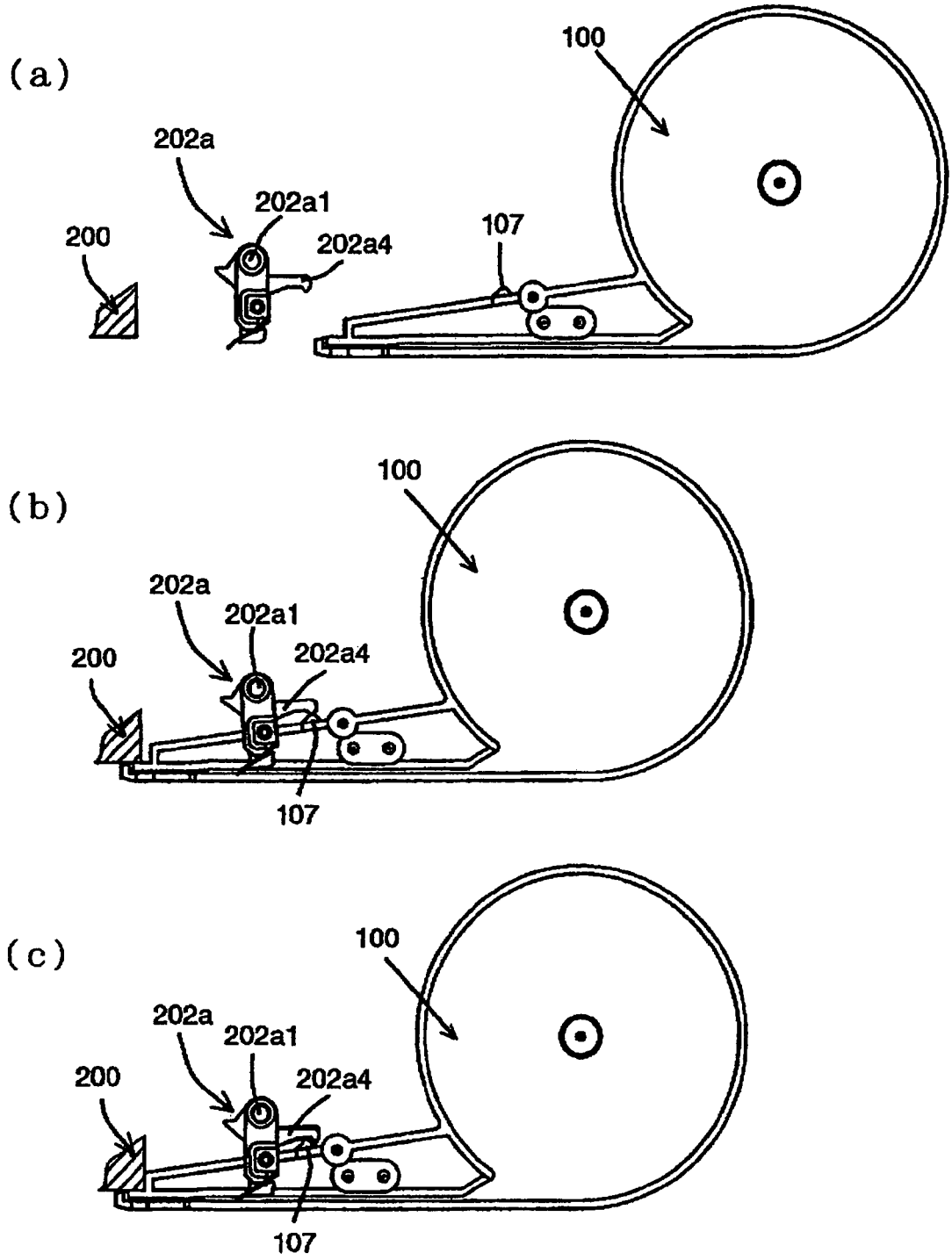
FIG. 4 A partial conceptual explanatory view to illustrate the series of operations to mount the staple cartridge to the cartridge holder according to the embodiment of the instant invention.

FIG. 3 and FIG. 4 illustrate the mechanism for advancing the staple sheet material 101. When mounting the staple cartridge 100 to the cartridge holder 200, even if the leading edge of the staple on the staple sheet material 101 stored in the staple cartridge 100 is not properly touching the leading edge stoppers 106 and is off by the dimension x, the action of the apparatus advances the dimension x that is off to securely touch the leading edge of the staple on the staple sheet material 101 to the leading edge stoppers 106.

So, the following positional relationship exists for the feed pawl advancement protrusion 107 on the staple cartridge 100 and the staple feed means 202 on the cartridge holder 200.

First, the staple feed means 202 is composed of the feed pawl member 202*a* and the feed pawl spring 202*b* comprising a leaf spring to constantly urge the feed pawl member 202*a* in the direction of the staple feed.

The feed pawl member 202*a* is rotatingly supported on the cartridge holder 200 by one side of the shaft 202*a*1. To the other side is mounted the feed pawl 202*a*2 abutting the staple sheet material 101 to advance staples.

The feed pawl member 202*a* is rocked and becomes charged in the counterclockwise direction by the abutting arm 302*a*3 that protrudes into the range of shaft movement on the feed pawl charge means 355 which is disposed on the anvil head 353 of the anvil unit 350 when mounted to the stapler unit 303 and comprises the cartridge advancing arm 202*a*4 that advances the staple sheet material 101 by rocking to recover in the clockwise direction by the feed pawl spring 202*b* with the passing of the feed pawl advancing protrusion 107.

As shown in FIG. 3, the dimension of the gap between the leading staple on staple sheet material 100 and the leading edge stoppers 106 on the staple cartridge 100 is x, the dimension for the rocking of the abutting part on the cartridge advancing arm 202*a*4 by the feed pawl advancing protrusion 107 on the staple cartridge 100 is y, the distance of the center of the shaft 202*a*1 to the staple abutting part on the feed pawl 202*a*2 is R1 and the length of the center of the shaft 202*a*1 to the cartridge advancing arm 202*a*4 that abuts the feed pawl advancing protrusion 107 is R2, the relationships of the dimensions thereof being set in advance to be:

$$R1\ \sin(y/2\pi R2*360°)>x$$

The width of the staple to use in this embodiment is 0.424 mm. R1 is 17 mm, R2 is 12 mm and y is 1.2 mm.

$$R1\ \sin(y/2\pi R2*360°)\cong 17\ \sin 5.7\cong 1.7\ \text{mm}$$

It is possible to correct the difference (1.7−x) with the value of x at this point.

FIG. 4 shows the essential state to illustrate the operation of the staple advancing feed when mounting the staple cartridge 100 to the cartridge holder 200, as shown in FIG. 2 and FIG. 3.

FIG. 4(*a*) shows the staple cartridge 100 being inserted into the guide 206 on the cartridge holder 200 shown in FIG. 2.

FIG. 4(*b*) the feed pawl member 202*a* being rocked in the counterclockwise direction and thus charged by the feed pawl 202*a*2 resisting the force of the feed pawl spring 202*b*, shown in FIG. 3, to be displaced sliding over the top surface of the staple sheet material 101 by the downward pressing of the cartridge advancing arm 202*a*4 of the feed pawl member 202*a* on the feed pawl advancing protrusion 107 of the staple cartridge 100.

FIG. 4(*c*) shows the leading staple on the staple sheet material 100 being pressed into the leading edge stoppers 106, the staple cartridge 100 being further pressed inward in the state shown in FIG. 3. When completely mounted to the cartridge holder 200, the cartridge advancing arm 202*a*4 on the feed pawl member 202*a* passes the feed pawl advancing protrusion 107 and is urged by the feed pawl spring 202*b* shown in FIG. 3 in the clockwise direction around the shaft 202*a*1.

Figure 5:
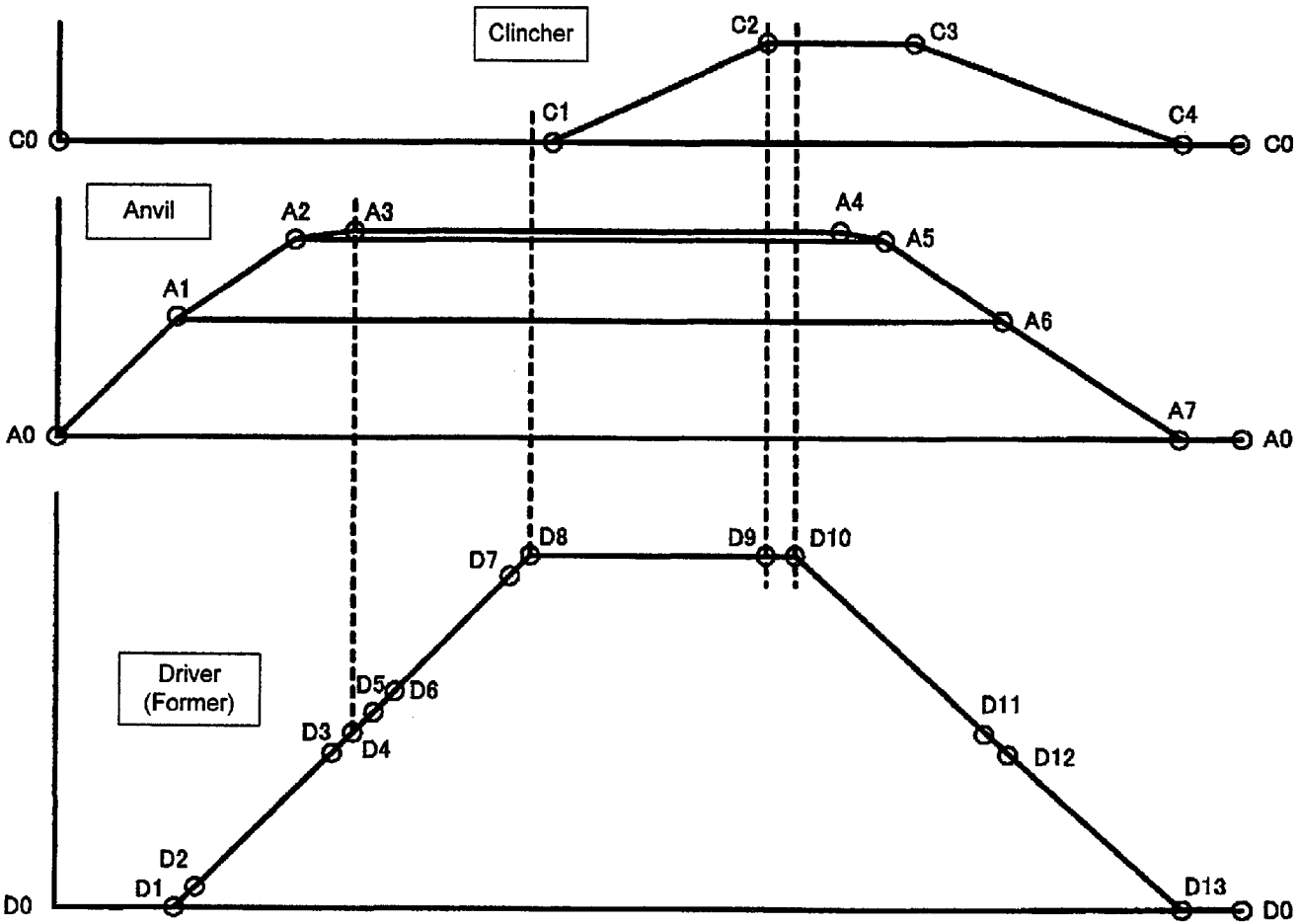
FIG. 5 A timing chart of the operations of the stapler apparatus according to the embodiment of the instant invention.

FIG. 5 is a timing chart to illustrate the operation of each of the driver, former, anvil and clincher units' processes. The horizontal axis indicates the angle of rotation of the drive cam that drives each unit and the vertical axis shows the amount of displacement of the levers for each unit. The following generally describes the series of actions according to FIG. 1.

Initially, along with the setting to the stapling position of the binding means a staple execution instruction signal is output to the stapler apparatus from an outside source.

The instruction signal starts the rotation of the direct current motor in the electric drive unit, which is not shown in the drawings, first pushing the actuating lever 340 in the downward direction by the anvil drive cam, which is not shown in the drawings, resisting the anvil spring 380.

Following the displacement of the actuating lever 340, the anvil unit 350 moves downward to start the nipping of the binding means.

Note that, interlocked to the nipping of the anvil unit 350, the clincher unit 360 interlocked by the interlock lever 370 and the clincher spring 400 follows the anvil unit 350.

To describe the operation of the clincher unit 360, it starts moving from its home position A0, and the rocking stops at a nipped position according to the thickness (the number of sheets) of the binding means set at the binding position, between the position A1 where, for example, 100 pages of the binding means are nipped to the position A2 where 0 pages of the binding means are nipped.

After nipping the binding means with the clincher unit 360, only the actuating lever 340 continues displacement resisting the paper thickness absorbing springs 390. The clincher unit 360 can be displaced to the position equivalent to the position A3 by applying an over-stroke to the position A2 to enable the secure nipping even if there are 0 pages of the binding means, in consideration of variations in parts and their assembly, to complete the nipping operation of the binding means using the clincher unit 360.

Before operating to the position A3 to complete the nipping operation of the binding means using the clincher unit 360, the driver 332 is displaced upward by the driver drive cam, which is not shown in the drawings, the displacement pressing upward following the former 333.

The driver 332 begins moving from the position D1 when the clincher unit 360 is beyond the position A1, at position D2, the former 333 presses the staple drawing to the driving position and starts forming the staple into a U-shape. In the continuing stroke, by pushing both leading edges of bent staples formed into that shape against the sides of the bending block 335 to guide it, both leading edges of the staple are secured front, back left and right by the non-magnetic materials of the guide plate 204 walls composed of the former 333, the bending block 335 and the cartridge holder 200.

Then, the leading edges that touch the staple formed by the driver 332 are pressed into the oblique surfaces of the bending block 335. With the bending block 335 retracted from the range of movement of the leading edge of the driver 332, the leading edge of the driver 332 touches the formed staple at the position D3. The leading edges of the formed staple pressed by the driver 332 delayed from the position A3 nipping the binding means of the anvil unit 350 reach the position D4 that touches the sheet surface of the binding means and the driver 332 starts driving the formed staple into the binding means.

After the driver 332 starts driving the staple, at the same time that the abutting portion that was abutting the former 333 on the driver 332 is released from abutting, by the level protrusion on the sheath 334 at the slightly delayed position D5, the former 333 is released from abutting with the driver 332 at the position D6 just prior to the leading edge of the former 333 touching the surface of the sheets of the binding means and the former 333 stops and the former guides the bend staple driven by the driver 332.

Continuing, the formed staple is driven by the driver 332, and after the formed staple crown touches the surface of the sheets of the binding means at the position D7, the driver 332 is further driven by the driver drive cam at the position D8. However, because the driver 332 cannot press the formed staples in, the driver 332 comprising a leaf spring itself is elastically deformed for the amount of the over-stroke to absorb the difference of the mounting position to securely drive the formed staple.

Then, directly after the position D8 where the formed staple is driven by the driver 332, the clincher unit 360 rocks downward by the clincher unit 602 from position C1 immediately after the position D8 by the clincher drive cam, which is not shown in the drawing, pressing the clincher 354 to complete the clinching operation at the position C2 by bending the leading edges of the staples that have penetrated the binding means.

After the clinching operation is completed, first, the recover operation is started for the driver 332 at the position D11. The former 333 part way is re-interlocked and returned to the position D0 which is equivalent to the initial position passing through the positions of D12 and D13.

The anvil unit 350 recovery operation is started slightly delayed to the recovery operation of the driver 332 and is returned to the position A7 which is equivalent to the initial position passing through the position A6.

Finally, the anvil unit 360 recovery operation is started slightly delayed to the recovery operation of the driver 350 and is returned to the position C4 which is equivalent to the initial position to complete the series of the staple operation.

The invention claimed is:

1. A stapler apparatus comprising:

a staple cartridge for storing a sheet of linked staples;

a holding means for receiving said staple cartridge;

a staple feed means for sequentially feeding staples to a staple driving position during stapler operation; and an actuating means for actuating the staple feed means in response to insertion of said staple cartridge into said holding means.

2. The stapler apparatus according to claim 1, wherein said staple feed means includes a feed pawl that rocks around a pivot point, and wherein said actuating means includes a rocking arm coupled with the feed pawl and an abutting protrusion on said staple cartridge that abuts and rocks said rocking arm upon insertion of said staple cartridge into said holding means.

3. The stapler apparatus according to claim 2, wherein the actuating means and the staple feed means together define a relationship where (x) is a gap between the driving position and a leading edge of the staple, (y) is the amount of displacement of the rocking arm by the abutting protrusion, (R2) is the length of the rocking arm from the rocking pivot point and (R1) is the length of the feed pawl from the rocking pivot point, the relationship being expressed in the following equation:

$$R1\ \sin(y/2\pi R2*360°)>x.$$

4. A stapler comprising:

a staple cartridge containing a sheet of linked staples;

a stapler assembly configured to receive the staple cartridge;

a staple feed member operable to sequentially feed the staples to a staple driving position during stapler operation; and an actuating mechanism coupled with the staple feed member to actuate the staple feed member upon insertion of the staple cartridge into the stapler assembly;

wherein the actuating mechanism includes a rocking arm coupled to the staple feed member, the rocking arm being movable upon insertion of the staple cartridge into the stapler assembly to cause movement of the staple feed member; and wherein the staple cartridge further includes an advancing protrusion configured to engage and move the rocking arm to thereby cause movement of the staple feed member upon insertion of the staple cartridge into the stapler assembly.

5. The stapler of claim 4, wherein the staple feed member includes a feed pawl engageable with the sheet of linked staples.

6. The stapler of claim 4, wherein the staple feed member is pivotably mounted on the stapler assembly.

7. The stapler of claim 4, wherein the actuating mechanism and the staple feed member together define a relationship where a gap (x) exists between the driving position and a leading edge of a staple, a displacement (y) occurs during engagement of the rocking arm and the advancing protrusion, the rocking arm has a length (R2) measured from a pivot point of the staple feed member, and the staple feed member has a length (R1) measured from the pivot point of the staple feed member, the relationship being expressed in the following equation:

$$R1\ \sin(y/2\pi R2*360°)>x.$$

8. The stapler of claim 4, wherein the stapler assembly includes a stapler unit and a cartridge holder removably mounted to the stapler unit.

9. The stapler of claim 8, wherein the staple feed member and the actuating mechanism are coupled to the cartridge holder.

10. A method of inserting a staple cartridge into a stapler assembly, the staple cartridge containing a sheet of linked staples, and at least one of the staple cartridge and the stapler assembly including a staple feed member operable to sequentially feed the staples to a staple driving position during stapler operation, the method comprising:

aligning the staple cartridge with the stapler assembly;

inserting the staple cartridge into the stapler assembly; and during insertion of the staple cartridge into the stapler assembly, actuating the staple feed member to advance a first staple in the sheet of linked staples to the staple driving position;

wherein an actuating mechanism is coupled with the staple feed member, and wherein actuating the staple feed member includes moving the actuating mechanism during insertion of the staple cartridge into the stapler assembly; and wherein the actuating mechanism includes a rocking arm coupled to the staple feed member, and wherein moving the actuating mechanism includes engaging the rocking arm with an advancing protrusion on the cartridge and moving the rocking arm to actuate the staple feed member.

11. The method of claim 10, wherein actuating the staple feed member advances the first staple in the sheet of linked staples through a distance (x) between the driving position and a leading edge of the first staple as defined by the equation:

$$R1\ \sin(y/2\pi R2*360°)>x$$

wherein (y) is a displacement that occurs during engagement of the rocking arm and the advancing protrusion, (R2) is a length of the rocking arm as measured from a pivot point of the staple feed member, and (R1) is a length of the staple feed member as measured from the pivot point of the staple feed member.

12. The method of claim 10, wherein actuating the staple feed member includes pivoting the staple feed member to feed staples to the staple driving position.

13. The method of claim 10, wherein the stapler assembly includes a stapler unit and a cartridge holder removably mountable to the stapler unit, and wherein inserting the staple cartridge into the stapler assembly includes inserting the staple cartridge into the cartridge holder before mounting the cartridge holder to the stapler unit.

14. The method of claim 10, wherein the stapler assembly includes a stapler unit and a cartridge holder removably mountable to the stapler unit, and wherein inserting the staple cartridge into the stapler assembly includes inserting the staple cartridge into the cartridge holder after mounting the cartridge holder to the stapler unit.

* * * * *